US007021010B2

(12) United States Patent
Smith et al.

(10) Patent No.: US 7,021,010 B2
(45) Date of Patent: Apr. 4, 2006

(54) DEMOUNTABLE BUILDING

(75) Inventors: Aaron Michael Smith, Singleton (AU); Michael Radford Smith, Whittingham (AU); Adam Shipway, Crows Nest (AU)

(73) Assignee: Aaron Smith Pty. Ltd., New South Wales (AU)

( * ) Notice: Subject to any disclaimer, the term of this patent is extended or adjusted under 35 U.S.C. 154(b) by 0 days.

(21) Appl. No.: 10/826,407

(22) Filed: Apr. 19, 2004

(65) Prior Publication Data

US 2004/0194401 A1 Oct. 7, 2004

Related U.S. Application Data

(63) Continuation of application No. PCT/AU02/01406, filed on Oct. 16, 2002.

(51) Int. Cl.
*E04B 1/343* (2006.01)
*B62D 24/04* (2006.01)

(52) U.S. Cl. ..... 52/169.12; 52/79.9; 52/143; 52/282.4; 52/582.1; 296/29; 296/210

(58) Field of Classification Search ..... 52/68, 52/79.1, 79.5, 79.12, 264–265, 270–272, 52/143, 653.1, 79.9, 79.13, 282.3, 282.4, 52/459, 464, 468, 582.1; 296/19, 24.1, 171, 296/29, 24.3, 168, 203, 210
See application file for complete search history.

(56) References Cited

U.S. PATENT DOCUMENTS

| | | | | |
|---|---|---|---|---|
| 2,678,442 | A * | 5/1954 | Ensor | 296/173 |
| 3,971,395 | A * | 7/1976 | Lipinski | 280/19.1 |
| 4,129,970 | A | 12/1978 | Whitney | |
| 4,175,362 | A | 11/1979 | Frederick | |
| 4,183,185 | A | 1/1980 | Farge | |
| 4,596,100 | A | 6/1986 | Grocott | |
| 4,992,669 | A * | 2/1991 | Parmley | 290/1 R |
| 5,218,792 | A * | 6/1993 | Cooper | 52/46 |
| 5,245,838 | A * | 9/1993 | Cavalea, III | 62/259.1 |
| 5,553,906 | A * | 9/1996 | Kunz | 296/29 |
| 5,727,353 | A * | 3/1998 | Getz et al. | 52/79.1 |
| 5,833,295 | A * | 11/1998 | Farlow, Jr. | 296/22 |
| 5,950,373 | A * | 9/1999 | von Hoff et al. | 52/79.5 |
| 6,119,427 | A * | 9/2000 | Wyman et al. | 52/584.1 |
| 6,260,322 | B1 * | 7/2001 | Lindsay | 52/474 |

FOREIGN PATENT DOCUMENTS

| | | |
|---|---|---|
| AU | 7822/66 A | 1/1969 |
| AU | 20866/83 A | 5/1984 |
| AU | 59156/86 A | 1/1987 |
| CH | 690689 A5 | 12/2000 |
| FR | 2 680 536 A1 | 2/1993 |

* cited by examiner

*Primary Examiner*—Winnie Yip
(74) *Attorney, Agent, or Firm*—Foley & Lardner LLP

(57) ABSTRACT

A structure such as a demountable building (10) including a base (11), a plurality of modular units (12–17) which are arranged for connection to the base (11). Each unit is fitted out with functional elements to enable that unit to perform a predetermined function in the operation of the building (10). Each unit (12–17) and its associated functional elements being operative to be connected to, or removed from, the base (11) as a single unit.

26 Claims, 13 Drawing Sheets

DEMOUNTABLE BUILDING

The present invention relates generally to modular buildings and in particular to demountable buildings and has been designed especially, but not exclusively, for use as buildings in remote locations.

BACKGROUND

Demountable buildings are typically permanent or semi-permanent structures which are used in activities requiring on site equipment and/or personnel for extended periods of time. These types of facilities are required in activities such as mining, construction, exploration, research, emergency services, aid organisations and armed services operations.

Permanent or semi-permanent structures of the prior art are erected at the site, and the various utilities such as power and water supply are shipped in separately. This approach has proven impractical in many cases particularly where the locations are remote and/or there is no readily available water or power supply in these regions. This has not only created problems in providing living and working conditions in these regions, but also makes construction of the actual facilities problematic.

Accordingly, it is an aim of this invention to provide an improved demountable building which ameliorates these problems and which is more easily installed and maintained, particularly in remote locations.

SUMMARY OF THE INVENTION

According to a first aspect of the invention there is provided a demountable building including a base, a plurality of modular units which are arranged for connection to said base, each unit being fitted out with functional elements to enable that compartment to perform a predetermined function in the operation of the building, each unit and its associated functional elements being operative to be connected to, or removed from, said base as a single unit.

A building according to the invention may be used to provide one or more functions. Examples of such functions include accommodation, laboratories, communication stations, other technical facilities, storage facilities, first aid facilities, toilet facilities or any other function that is required in the field.

Each modular unit may form a modular compartment having a compartment housing and functional elements which are fitted in or to the housing and which provide the compartment with a particular function. For example, a modular compartment providing toilet facilities may include toilets, washing and shower components and fitted to its respective housing. A compartment for providing sleeping facilities may be fitted with beds and washing facilities. A utilities compartment may be fitted with a generator, or a gas supply. A water tank compartment may be fitted with water supply facilities. A waste tank compartment may be fitted with functional elements for storage and/or treatment of waste. The functional elements are designed to be fixed to the compartment housing so that the compartments and the functional elements may be installed or removed as a single unit.

The number of modular units that can be releasably mounted to the base can vary depending on the size of the modular units and the size of the base. In a preferred embodiment of the building of the present invention, three or more modular compartments are releasably mounted to the base. However, it is to be appreciated that the number of units or compartments may vary considerably depending on the requirements of the demountable building.

In one form, one or more of the units includes structural members. The structural members may be designed to allow each unit to be fully self supporting to enable those units to be readily transported and handled. Further, in the embodiment where a base is included, the structural members may be designed to increase the bending strength of the base.

The units may include a single structural member in the form of a subframe which can be mounted on and fixed to the base. A unit which includes only a subframe may include functional elements which are assembled on the subframe. The units which take the form of compartments may include further structural members preferably which define a generally square or rectangular interior space. For example, the compartments may include a pair of end walls which extend substantially vertically when connected to the subframe and a pair of side walls which also extend substantially vertically and between the end walls. A roof member may close the open end of the end and side walls to define an interior cavity of square or rectangular configuration. Typically a compartment will include at least a pair of end walls and optionally one or more side walls.

In one arrangement, a large compartment may be formed by two or more smaller or standard sized compartments assembled side-by-side. If two compartments are assembled side-by-side, then each compartment can comprise a pair of end walls, a roof member and one outer side wall. Such compartments will then be open at the junction between them to create the larger compartment, which is otherwise enclosed.

In another arrangement, a larger compartment may be formed by three standard sized compartments assembled side-by-side. The larger compartment will comprise two end compartments and an intermediate compartment. The end compartments will be constructed as for the larger compartment described above, with a pair of end walls, a roof member and an outer side wall, while the intermediate compartment will have a pair of end walls and a roof member only. Like the earlier compartment, this larger compartment will be open at the junction between the three standard sized compartments, but otherwise enclosed along the sides and ends thereof and the roof.

In each of the above arrangements, each of the standard sized compartments assembled side-by-side to create the larger compartment may have a separate subframe, or a single larger subframe may be employed. A single larger subframe will assist with creating rigidity in the building, whereas smaller subframes will facilitate more flexible rearrangement of the building structure.

The reference to "standard" sized compartments is a reference to a preferred form of the invention, in which many of the compartments employed to construct a demountable building are of a standard form and size. For example, it is preferred that the end and side walls and the roof members described above, have a standard size and shape, and that the form of building required can be constructed from those standard compartments, rather than having to select from a variety of different sized and shaped end and side walls and roof members. The desirability for standard componentry extends to the connections between the walls and roof members, and between adjacent compartments, and between the walls and subframes. This limits the number of different dies and extrusions etc. required for manufacture of the componentry, as well as the stock of components required to be maintained by a supplier/constructor of demountable buildings according to the invention. It also facilitates simplified building construction by limiting the complexity of the construction for the actual construction personnel.

As will be appreciated, the above discussion allows for deviation from standard componentry in respect of the subframe, but this does not overly add to the complexity of the invention. In one respect however, the larger subframe typically will be a multiple at least in size, of the smaller standard sized subframe, so that a certain level of uniformity will be retained despite the size difference.

In one embodiment of the invention, connectors extend between adjacent building components to connect those components together. Bolts or screw threaded fasteners may be employed.

In an alternative arrangement, elongate connecting members may be employed to connect between edge regions of end and side walls and connectors, such as those described above, may be employed between the connecting members and the walls. The connecting members preferably extend the full height of the end and side walls so that they can also be connected to the subframe (if provided) and any roof members. The connecting members preferably are hollow so that a connector can extend through a wall and into an internal cavity thereof and preferably the connector can be used between adjacent side and end walls, adjacent side walls and adjacent end walls. In one arrangement, the connecting member has parallel and spaced-apart front and rear walls, and side walls which extend between the front and rear walls and which preferably are mutually inclined in a converging manner. Preferably they are each inclined at 45°. Likewise, the edge regions of the end and side walls preferably are inclined in the same manner, so that the side walls of the connecting members can substantially abut flush against the inclined edge regions, regardless of whether the walls are adjacent end and side walls, a pair of adjacent side walls, or a pair of adjacent end walls.

Preferably each of the end and side walls and the roof members are formed of an extruded plastic shell which is hollow and filled with an insulating foam. The skin could alternatively be formed of metal, such as sheet aluminium, but the preferred wall construction has been found to provide excellent structural and insulative characteristics, with acceptable weight, cost and manufacturing characteristics. The preferred wall construction also facilitates window and door installation, by simply cutting through the wall with a suitable saw, eg a jigsaw, or a circular saw, and fitting the window or door in the opening formed therein.

The subframe may be secured to the base in any suitable manner, although the preferred arrangement provides for lugs which extend downwardly from the subframe and upwardly from the base, and each of which includes eyelets for receipt of locking means. For example, a pin can extend through respective eyelets and in the preferred form, the pin is a rod which extends through a plurality of eyelets, so that the subframe can be secured to the base at several lug positions by a single rod. Clearly in this arrangement, the eyelets need to be linearly aligned. Advantageously, the arrangement of lugs can be such as to facilitate insertion of the rod from the side or end of the base, so that a unit or compartment can be placed into the base and then the rod inserted from outside the base. In other words, in this arrangement there is no need for internal access to the lugs, or for access underneath the base.

In a preferred embodiment, the demountable building is transportable. The building may be transported by any means either as a complete structure and/or in a disassembled state where the units are transported separately. The transportability of the building and the units facilitates both its installation and removal. It also assists maintenance of the building by allowing individual units to be easily removed and replaced. Examples of suitable transport means include truck, train, boatship or plane, or combinations thereof.

Preferably, the base member may include a sliding means that allows the structure to be slid and/or lifted onto a transport means. Ideally the sliding means is a heavy-duty sled or skids incorporating tow lugs. This facilitates the sliding or lifting of the demountable building onto an appropriate transport means such as an industrial tilt tray truck. Alternatively, the base member may be equipped with wheels to allow towing or lifting onto a transport means. As a further alternative, the demountable building may be towable itself. A levelling arrangement may be applied to level the building on uneven or sloping ground.

In a preferred embodiment, the modular units may be interconnected to other modular units in a stacked configuration. Any number of modular units can be stacked but preferably the height of the stack does not prevent transportation of the structure. The modular units may vary in base area and volume depending on the function of each unit.

It is preferred that the units connected to form a building may be substituted with any units of the same size but for a different function, depending on the overall function required of the building. For example, in changing the function of a demountable building from a toilet facility to a kitchen facility, a unit having toilet facilities may be substituted for a unit having kitchen facilities. At the same time, a utilities unit providing electricity may be substituted for a utilities unit providing both electricity and gas.

In a preferred embodiment there is provided a building wherein each modular unit includes at least one service connection which is operative: to be connected to similar service connections of other modular units in the building. The service connections may consist of any type of connection to allow the modular units to function in the way they are intended. The types of service connections will determine what the service connection contains. In a preferred embodiment, the service connection contains one or more hose lines and one or more cable lines. In a preferred embodiment, the service connection contains at least two hose lines and at least one cable line.

In a preferred embodiment there is provided a building wherein the base includes at least one common service connection wherein the respective service connections of the modular units are arranged to be interconnected to the common service connection. The service connection may consist of any type of connection to allow the base to permit transfer of services from one modular unit to another. In a preferred embodiment, the service connection includes one or more hose lines and one or more cable lines. The service connections may be adapted so that when not in use, they may be capped or closed to prevent flow of services.

In a preferred arrangement, the base may include ducting which is centrally positioned between sides of the base and which extends lengthwise thereof preferably to each end. The ducting will include the service connection for connecting to each modular unit and preferably the connection point in the modular unit is uniform so that when a unit is replaced by another and different unit, the position of service connection to the ducting remains the same.

In a preferred embodiment there is provided a building wherein the service connection is any one of water, gas, electricity, or effluent.

In a further aspect of the invention, there is provided a modular unit for use in a demountable building in any of the above embodiments, having functional elements to enable the unit to perform a predetermined function in operation, wherein the unit is operative to be connected to, or removed from, other units or a base.

In a further aspect of the invention, there is provided a modular structure including a base, wall sections, roof sections and connectors for connecting adjacent wall sections and adjacent roof sections, the roof and wall sections being selected generally from a single predetermined size of respective wall and roof section for construction of said modular structure, said connectors extending lengthwise of said wall sections and including opposite side connection portions facilitating connection between said connectors on either side thereof to adjacent wall sections.

A modular structure according to the invention can take many suitable forms. For example, it may be a children's playhouse constructed in the backyard of a house, or in a playground, or it may be a garage or temporary shelter. In a particular form of the invention, the structure is erected as a truck or trailer body to partially or fully enclose the tray of a truck or trailer. These types of structures are particularly suited to erection from standard sized components as: provided by the invention, because they do not necessarily require exact dimensions which necessitate customized structures, and the simplicity of construction facilitates the need for minimal manpower and quick construction times.

The wall sections can take the form of the end and side walls discussed above, while the roof sections can take the form of the roof members discussed above. The connectors of this embodiment of the invention can be of the same form of the connectors discussed in relation to the embodiment of the demountable building. Accordingly, a structure can have a plurality of wall sections, side-by-side but separated by and connected together by connectors, each of the wall sections and the connectors being connected to the base and the roof sections being connected to the connectors.

A structure according to the invention can be totally enclosed, employing doors and windows as appropriate, or it can define an open structure, say including a pair of side wall sections and a single end wall section, or just a pair of side wall sections, and each including roof sections as required. A structure according to the invention can have a very similar appearance and construction to a demountable building according to the invention, but the structure is not required to be constructed in modular unit form and is not required to include the functional elements. The structure may be of the modular unit form and may include functional elements but it may also provide only a housing or cover, that is conveniently constructed with the modular components of the wall and roof sections, the connectors and the base.

It is convenient herein after to describe a preferred embodiment of the invention with reference to the accompanying drawings. It is to be appreciated that the particularity of the drawings and the related description does not supersede the preceding broad description of the invention.

BRIEF DESCRIPTION OF THE DRAWINGS

In the drawings:

FIGS. 1 and 3 show opposite side views of the building, whereas FIGS. 2 and 5 show views from above and below respectively. FIG. 4 is a perspective view of the building.

DETAILED DESCRIPTION OF THE EXEMPLARY EMBODIMENTS

Figure 1:
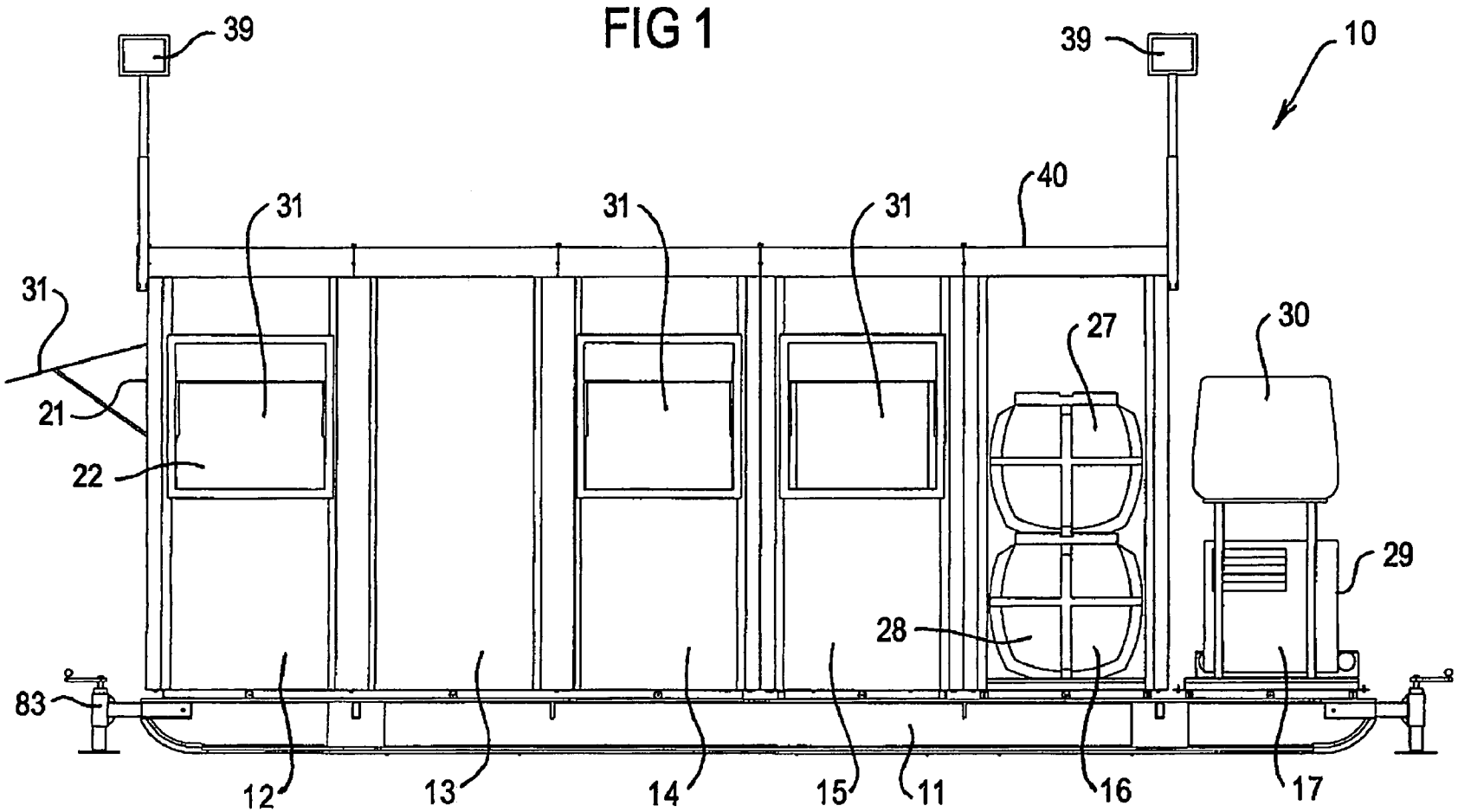
FIGS. 1 to 5 show different views of a building according to the invention.

Referring initially to FIGS. 1 to 5, there is shown a demountable building 10 which has a base 11 and a series of modular compartments 12 to 16 and a modular unit 17, each of which is releasably mounted to the base 11. The modular components include three compartments 12 to 14 which may for example comprise two compartments combined to form one large compartment for work personnel to work or relax, and a third compartment which could be a utilities compartment. The compartment 15 as shown is a toiletry compartment, while the compartment 16 includes water/waste storage tanks and a resources storage unit and the unit 17 includes a diesel generator and a compressor.

The compartments 12 to 14 can be divided by partitions to create three separate modules or the partitions can be omitted to create one large module as shown, so that a room is created having a floor area equal to the combined floor area of the three compartments 12 to 14.

Each compartment/unit (hereinafter "compartment") is connected releasably to the base 11 and optionally to an adjacent compartment. Advantageously, the releasable nature of the compartments permits ready removal of each compartment and exchange for another compartment of the same size but different function or the removal of two or more compartments to be replaced with a single compartment of larger size with a floor area which equals the sum of the pre-existing compartments.

For the preferred embodiment the fully assembled demountable building 10 is sized to fit on an industrial tilt tray truck and has a length of 7.6 m, a width of 2.5 m and a height of 3.0 m.

Each module can be an enclosed unit with four walls and a roof or can be an open unit with framework supporting items not required to be enclosed.

Each of the compartments 12 to 16 have a length of 1.25 m, a width of 2.4 m and a height of 2.5 m. One wall of the compartment 12 includes windows 20 to 23 while a door 24 is provided for entry to the compartment 13. If partitions are not installed, then the area of a room comprising compartments 12 to 14 will be 3.75 m by 2.4 m, which can include work benches, shelving, computer equipment or other equipment which may be required at the particular site at which the building 10 is installed, such as testing or analysing equipment Alternatively partitions may be installed to create three different areas, such as an office and a lunch room, or three offices, or two offices and an equipment room, or any other suitable combination.

As illustrated, the compartment 15 includes a toilet 25 and a basin 26, while a shower may also be provided.

It is the case that each of the compartments has the same length, width and height dimensions, although that is not essential. In one embodiment which is not illustrated, the compartment 13 has a length of 2 m, a width of 1.0 m and height of 2.5 m. Such a compartment in that embodiment can be a compartment containing a cleaner's sink and a bucket filling facility plus storage for mops/brooms, cleaning products and toilet/shower consumables.

The compartment 16 includes a water/waste storage arrangement comprising a clean water tank 27, a waste water and effluent storage tank 28 and a resources storage area. The unit or compartment 17 includes a diesel generator 29 and an air compressor 30. The compartment 17 is not required to include a roof or walls and is therefore completely open.

One advantage of the invention is that the features of each compartment form part of the compartment, so that assembly of a building 10 is a straightforward exercise in determining the required building features. For example, if a toilet and basin is required, then selection of the compartment 15 is made. Alternatively, if a shower is additionally required, then a different compartment will be selected. In the arrangement illustrated, because each compartment is of the same dimensions, one compartment can easily be substituted with another without disturbing the remaining compartments.

The compartments shown in FIGS. 1 to 4 include windows, or a door, or both. The compartments additionally include window shades or awnings 31 which are shown in a raised position in those figures. The awnings 31 shade or cover individual windows, while a larger awning 32 is shown which provides more extensive shading or coverage. The awnings 31,32 can additionally provide a security characteristic when closed, restricting access to within the building 10 when they are lowered and locked in place.

Figure 2:
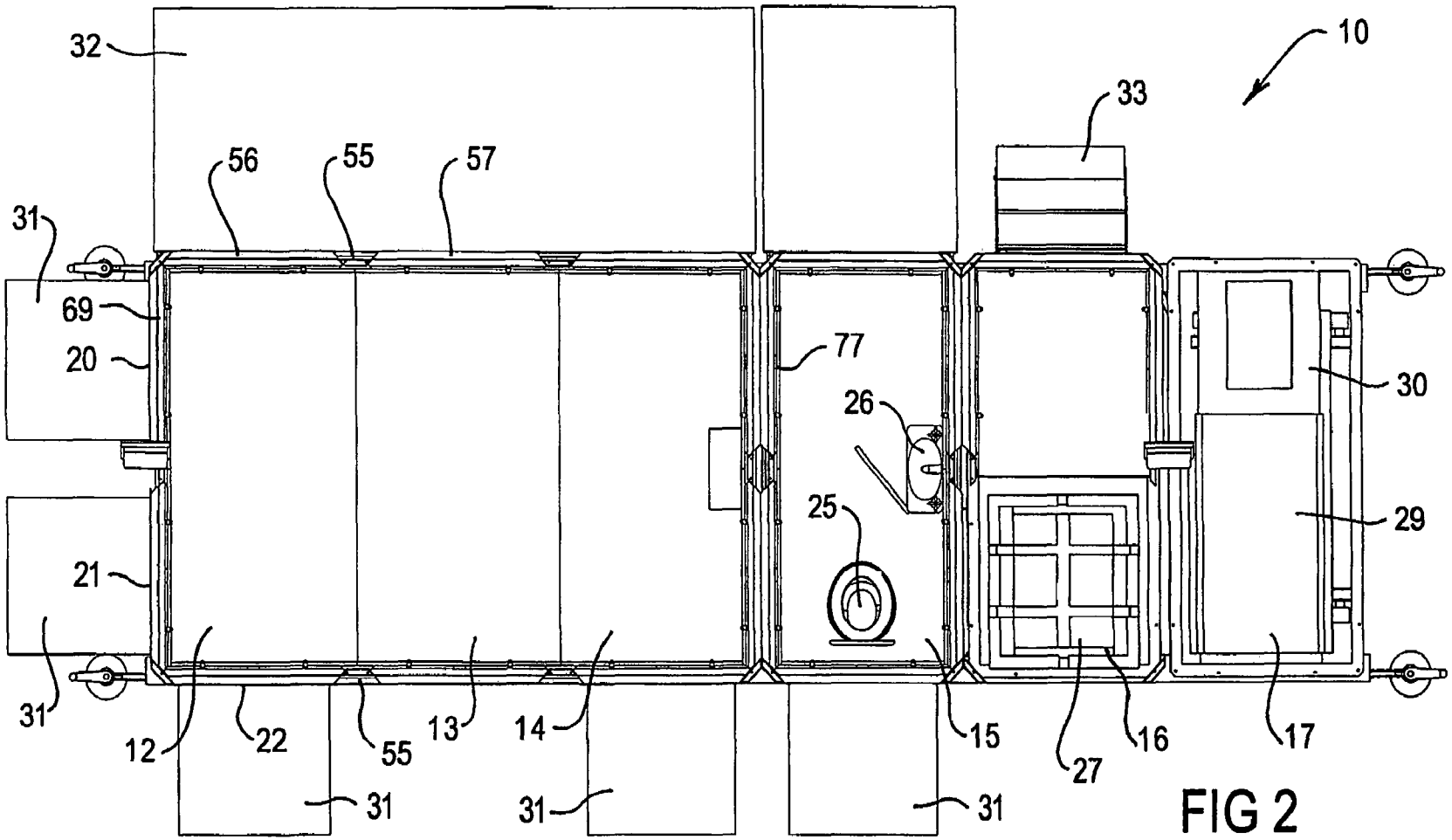
Figure 3:
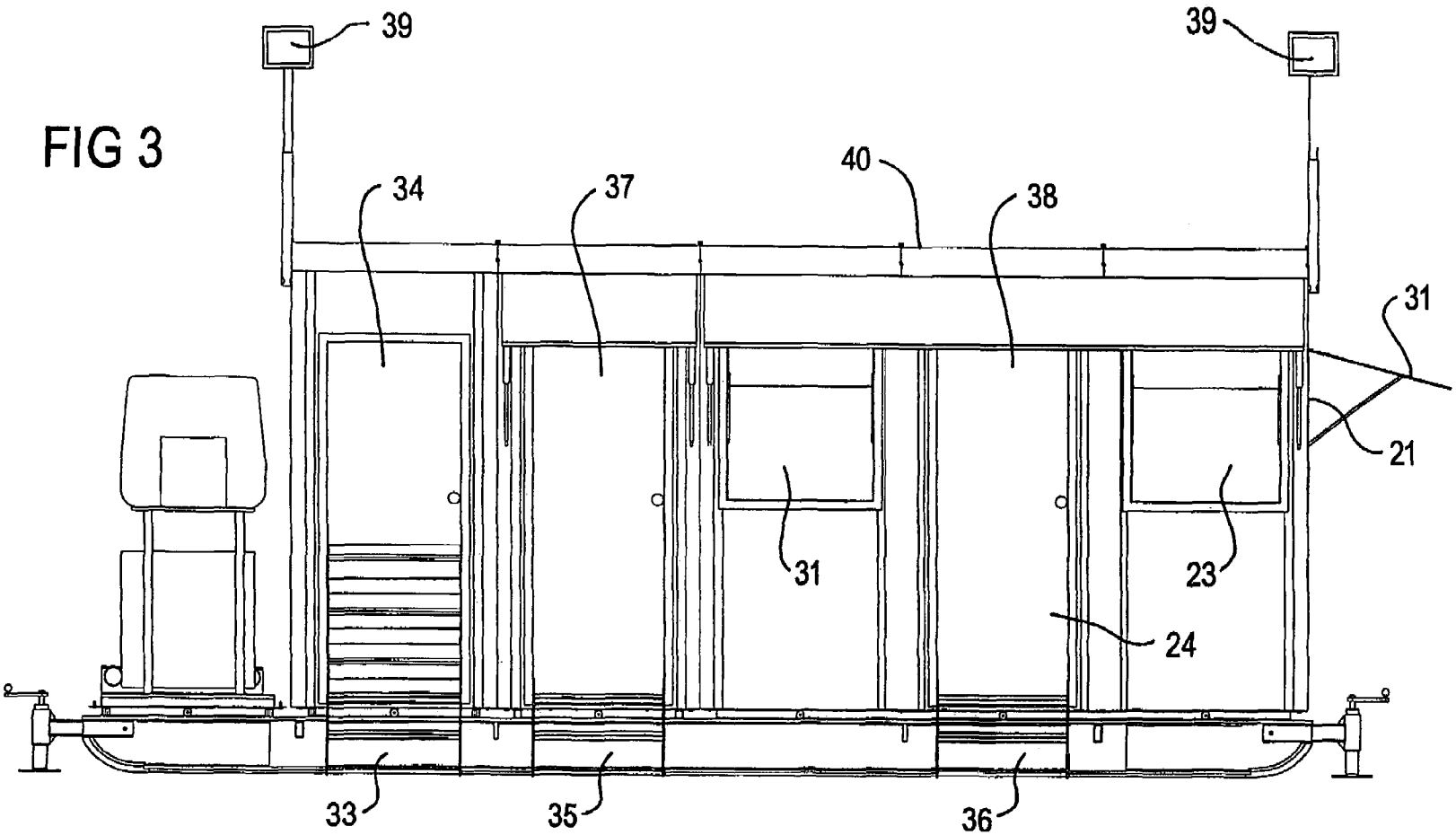

Steps 33 are shown in FIG. 2 extending from the door 34 of the compartment 16, while steps 35,36 also extend from the doors 37 and 24 of FIG. 3. The steps can be folded into or against the building 10, in a manner that provides for security of door closure. Retractable lights 39 and other required componentry can be attached to the root 40 and external walls.

The building 10 shown in FIGS. 1 to 4 is extremely useful for remote locations and can be conveniently be assembled either on-site, or remotely and transported to the site. The latter approach is preferred although either approach is acceptable.

Figure 5:
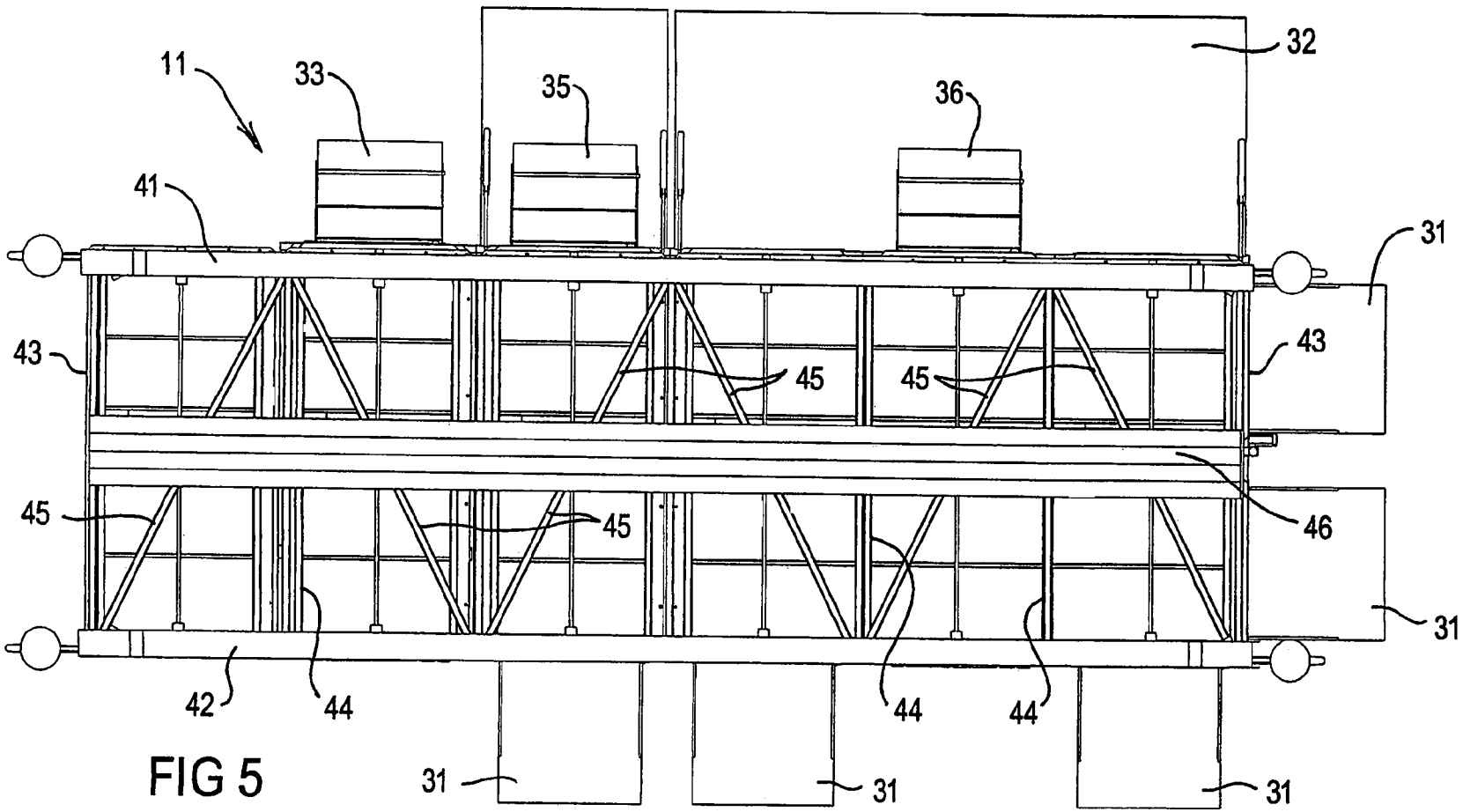

The base 11 of the building 10 can include a central utilities duct and such a duct is shown in the underneath view of the building 10 of FIG. 5. In that view, the base 11 is shown having a pair of side skids 41,42 which extend 20 lengthwise of the base 11 and which are connected by a pair of end struts 43, several intermediate struts 44 and several bracing members 45. The base 11 so formed is extremely robust and rigid. The ducting referred to above extends lengthwise and centrally of the base 11 at 46, and the central placement of the ducting 46 facilitates uniform location of connection points of the various compartments 12 to 17. That is, each compartment can be arranged for connection to the ducting 46 at the same location of the compartment and by that arrangement, assembly is facilitated in a uniform manner. As an example, the ducting 46 can include electrical, gas and plumbing connections as appropriate. The plumbing connections for example can include water delivery and effluent disposal piping.

The ducting 46 can be arranged to include service connection points at uniform spacing, to connect with a compartment which is fitted to the base 11 and which includes connectors for connection to the ducting through the service connection of the ducting. Each service connection of the ducting includes the same connections for the services available with the base, whereas each compartment may include only the connections required. For example the toiletry compartment 15 would require a connection for clean water for flushing and basin use, a further connection for disposal of sewerage and waste water, and an electrical connection for lighting. However, compartments 12 to 14 may only require electrical connection for lighting and other electrical equipment, such as computers and air conditioning.

Figure 6:
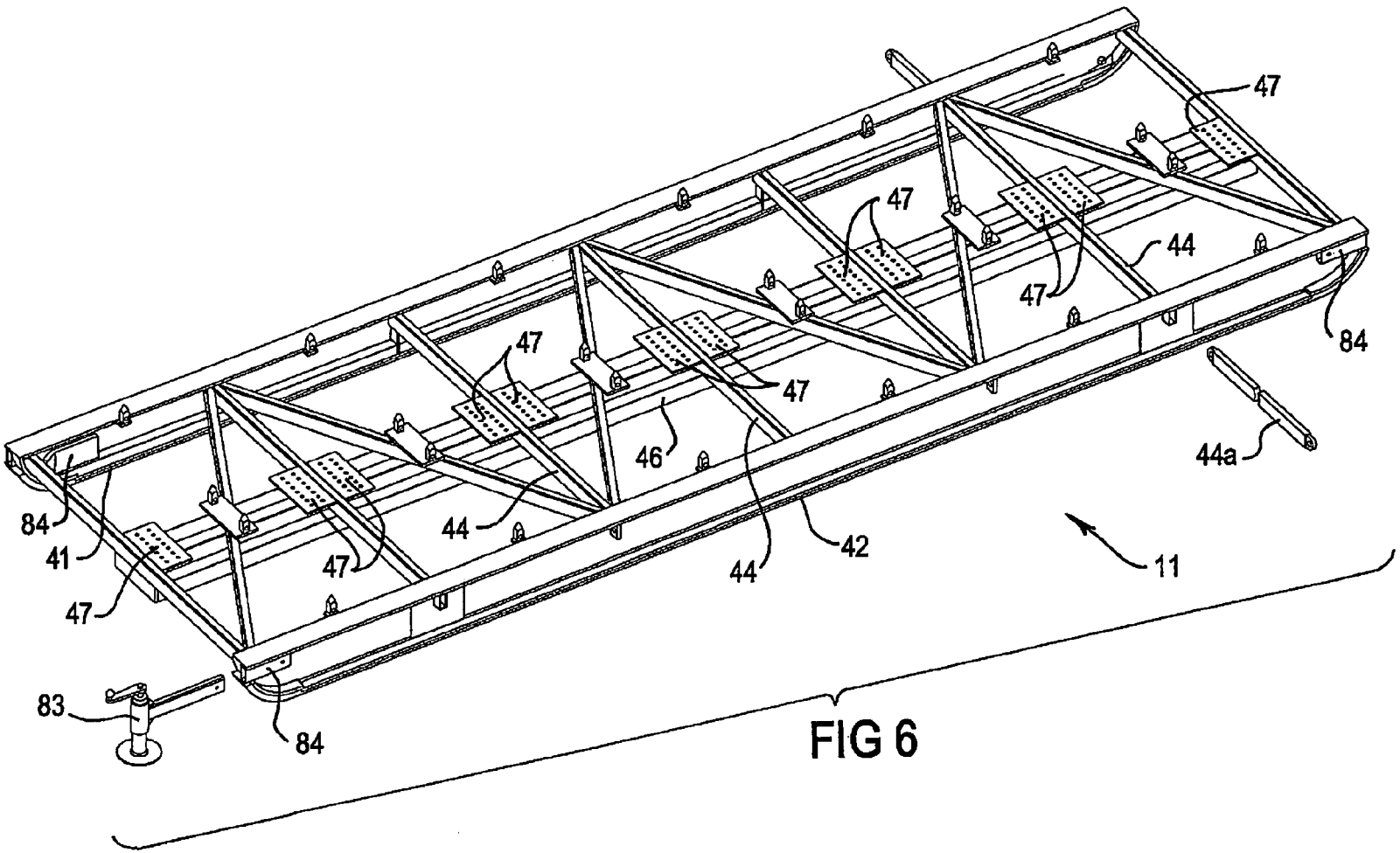
FIG. 6 is a perspective view of a base for a building according to the invention.

It is proposed that the service connection of the ducting 46 comprise bulkhead plates 47 at regular intervals as shown in FIG. 6. Each bulkhead plate 47 includes a plurality of connectors, although in the minimum, a cable connection for electricity supply and two hose connections for supply and disposal of liquid could be provided.

The connections can be a socket adapted for releasable connection with corresponding service connections of the modular compartments. The connection is made when the compartments are fitted to the base and the method of connection may be as simple as aligning the service connectors of each compartment with the relevant bulkhead plate as the compartment is lowered into the base. Likewise, detachment of the compartments from the base will disconnect the service connectors form the bulkhead plate.

If more secure connections are required, then threaded connectors may be employed, or other connectors as appropriate.

Referring back to FIGS. 1 and 4, the underside of the base 11 of the building 10 has skids 41,42 which extend along the length of the base of the building. The skids facilitate sliding of the building along the ground and allow the building to more easily be loaded onto transport trucks. Attached to each skid at each end of the skid are levelling devices 83 to level the building 10 on uneven ground.

Also attached to each skid at each end thereof are tow lugs in the region 84 (see FIG. 6). The building is loaded on a tilt tray truck by hauling it onto a tray using a tow chain that is attached to the tow lugs 84 at one end of the base. The building is slid and lifted by the tow lugs 84 onto the tray of the tilt tray truck. It is then slid into position on the truck and secured ready for transport. The building can also be lifted by crane using slide out lifting bars 44*a* fitted into forward and rear intermediate struts 44 (FIG. 6). The lifting bars 44*a* include eyelets at the ends thereof for receiving a lifting chain or loop. The lifting bars 44*a* can remain within the struts 44 between lifts, or they can be removed for reinsertion when required and a spreader bar and slings or chains (not shown). The building can also be lifted by an appropriate fork lift.

In operation, the demountable building is arranged to either be assembled off-site or transported in a disassembled form and assembled on site. Similarly, when the demountable building is no longer required at a site, it can either be transported away from the site assembled, or disassembled at the site and transported in a disassembled form.

An advantage of the building is that it is easily maintained. If one aspect of the buildings operation breaks down, runs out or is filled and needs to be replaced, the compartment can be uncoupled from the building as a single unit and replaced with a compartment having the same function. For example, when water tank 27 runs out of water, the compartment 16 containing the empty tank can be readily removed and replaced with a compartment containing a full tank. Similarly, when waste tank 28 is filled, it can be readily removed and replaced with an empty waste tank by replacing compartment 16.

A further advantage is that the building can be easily reconfigured to perform a different function. For example, a compartment, which provides toilet and shower facilities, may be removed and replaced with a different compartment having different facilities. That compartment might for example, provide kitchen facilities.

Each compartment can be secured to the base by any suitable arrangement. In the embodiment illustrated in FIG. 7, the base of the compartment 16 includes four spaced apart beams 48 which extend across the width of the compartment and each beam includes a central opening 49. The base 11 includes a plurality of eyelets 50 which each define an opening therein 30 and the respective openings are aligned when the compartment 16 rests on the base 11, so that a hold-down pin 51 can be threaded through the openings and to thereby lock the compartment 16 to the base 11. To secure the hold-down pin from release, one end thereof can include a head 52, while the opposite end can be threaded, to receive a nut or the like.

Figure 7:
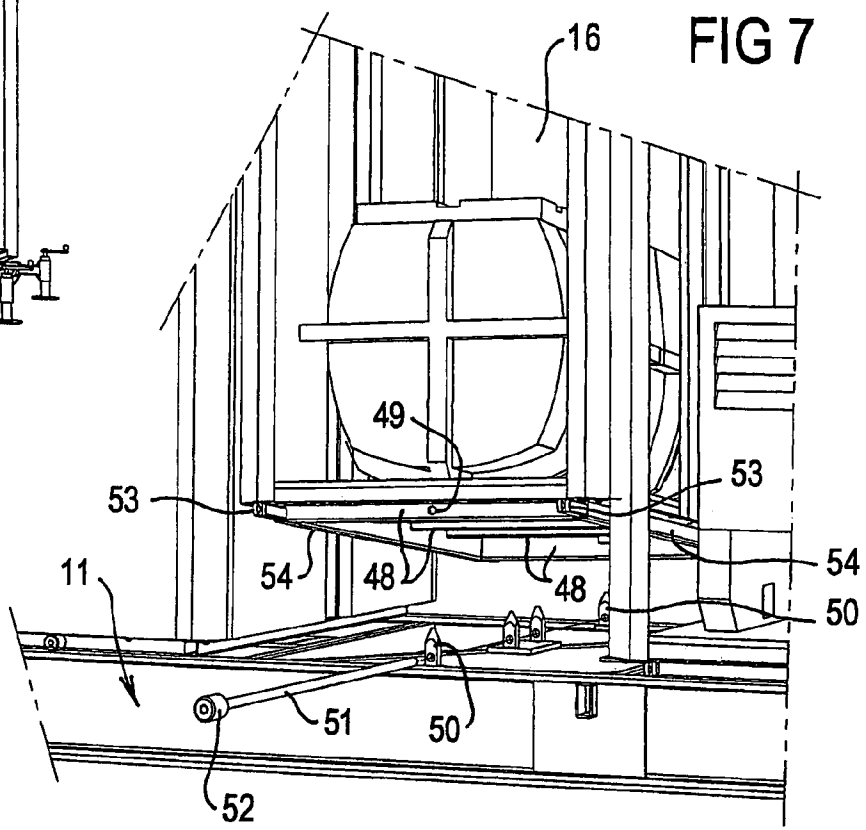
FIG. 7 is a detailed view showing assembly of a unit to a base of a building of the invention.
Figure 8:
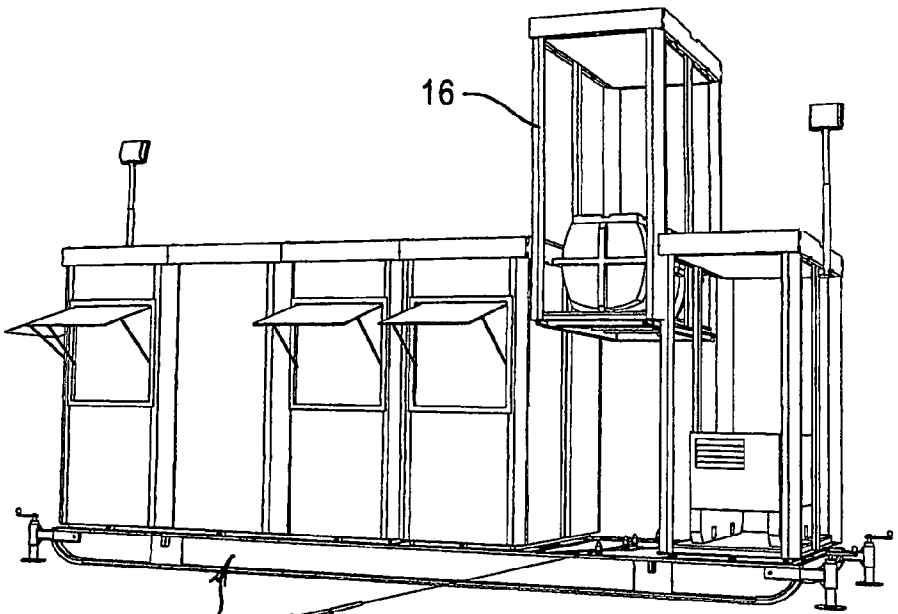
FIG. 8 shows an expanded view of the FIG. 7 view.

FIG. 7 also shows the lifting bars 53 which are employed for lifting and lowering the compartment 16. The lifting bars 53 are formed of square channel with eyelets at each end and are received in a close fitting relationship in tubular sections 54 of the base of the compartment 16. A lifting bar 53 is inserted into each end of each section 54 when it is necessary to raise or lower the compartment 16, and this is done by inserting lifting lugs (not shown) through the eyelets of the lifting bars 53 and lifting or lowering the compartment typically by crane. This arrangement is also shown in FIG. 8.

Referring back to FIG. 2, this shows the edge connections between adjacent compartments and in particular between adjacent-panels of adjacent compartments. Between the compartments 12 and 13, a connection 55 is provided which is illustrated in more detail in FIG. 9. In that figure, a panel 56,57 of each of the compartments 12 and 13 is shown. Each of the panels 56,57 includes a hollow plastic sheet skin which is filled with insulating foam. The facing ends of the panels 56 and 57 are asymmetrically convergent, each having a major converging wall 58,59 and a minor converging wall 60,61. The wall 58 extends past the junction with the wall 59, to define a free extension 62 which includes an opening to receive the shaft of a connector 63. The wall 60 does not include an extension, but instead includes a recess for recept of an extension plate 64 which includes an opening for receipt of the shank of a connector 65. The plate 64 is connected to the wall 60 by a screw connector 66.

The screw fasteners 63 and 65 extend into openings formed in a side joiner 67, which includes inclined ends to lay against the wall 58 and the plate 64. The joiner 67 includes an opening 68 in upper and lower end walls thereof for receiving a fastener to secure the joiner to a subframe of the compartment.

Figure 9:
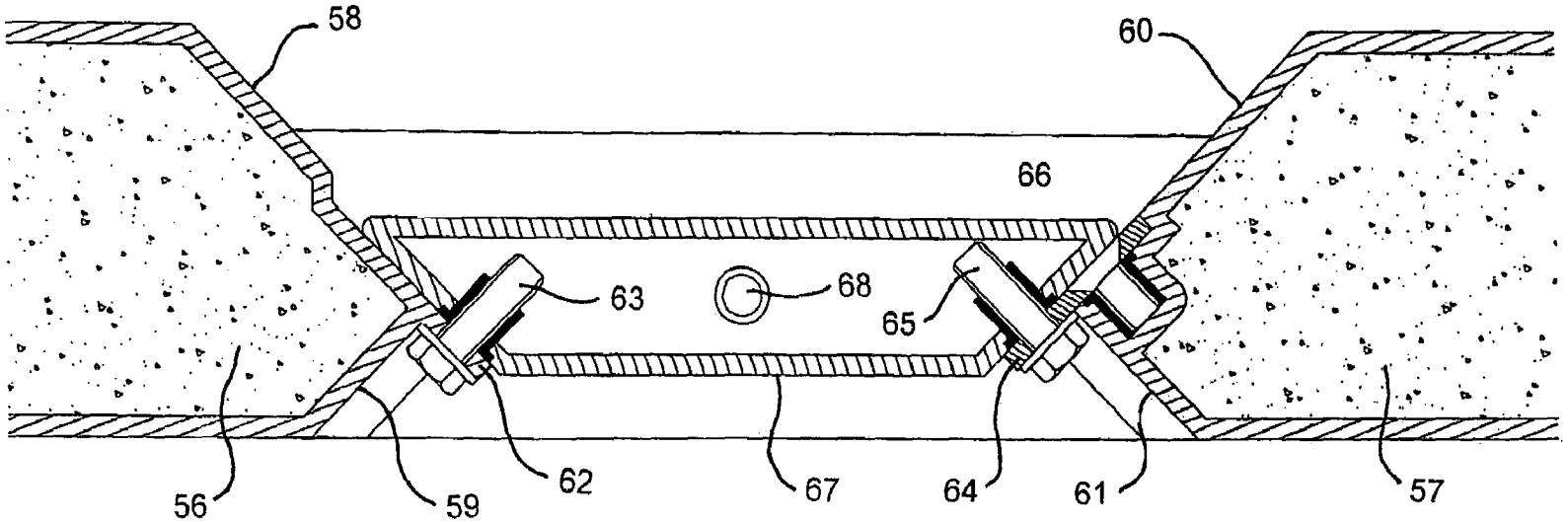
FIG. 9 is a cross-sectional view through a connection between adjacent side walls.
Figure 10:
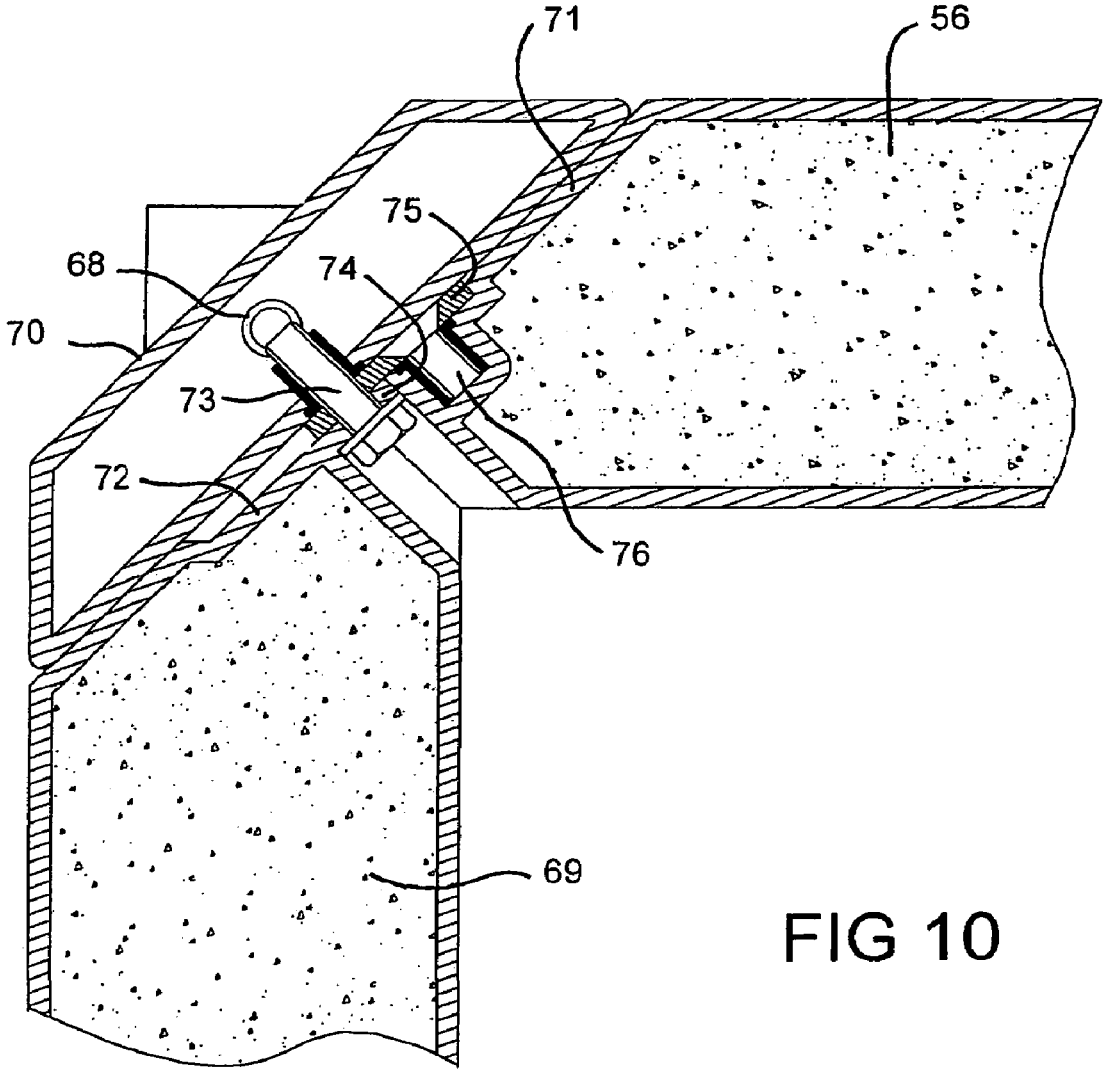
FIG. 10 is a cross-sectional view through the connection between adjacent side and end walls.

FIG. 10 shows a corner connection of the kind employed at each corner of the building 10 of FIG. 2. The corner connection advantageously employs the same shaped extrusion as the side joiner of FIG. 9, while further advantageously the panel ends which meet at the corner have the same configuration as those shown in FIG. 9. In the FIG. 10 arrangement, the opposite end of the panel 56 is shown meeting with a facing end of a further panel 69. In the FIG. 10 arrangement, the joiner 70, which is of the same configuration as the joiner 67, is fixed to the walls 71 and 72 of the panels 56 and 69 by a connector 73 which extends through a free extension 74 and a plate 75, the latter of which is fixed to the end wall 71 by a connector 76.

It will be appreciated that advantageously, the joiners 67 and 70 illustrated in FIGS. 9 and 10 are identical extrusions which advantageously reduces the number of different components required to construct the building 10. This interchangeability further extends to the junction between the compartments 14 and 15, in which a partition wall 77 is disposed between those compartments. This arrangement is shown in more detail in FIG. 11 in which external panels 77 and 78 are joined with the internal partition walls 79 and 80. In view of the preceding description relating to FIGS. 9 and 10, it can be easily appreciated as to how the joiners 81 and 82 are connected to the panels shown in FIG. 11 to connect them together.

Figure 12:
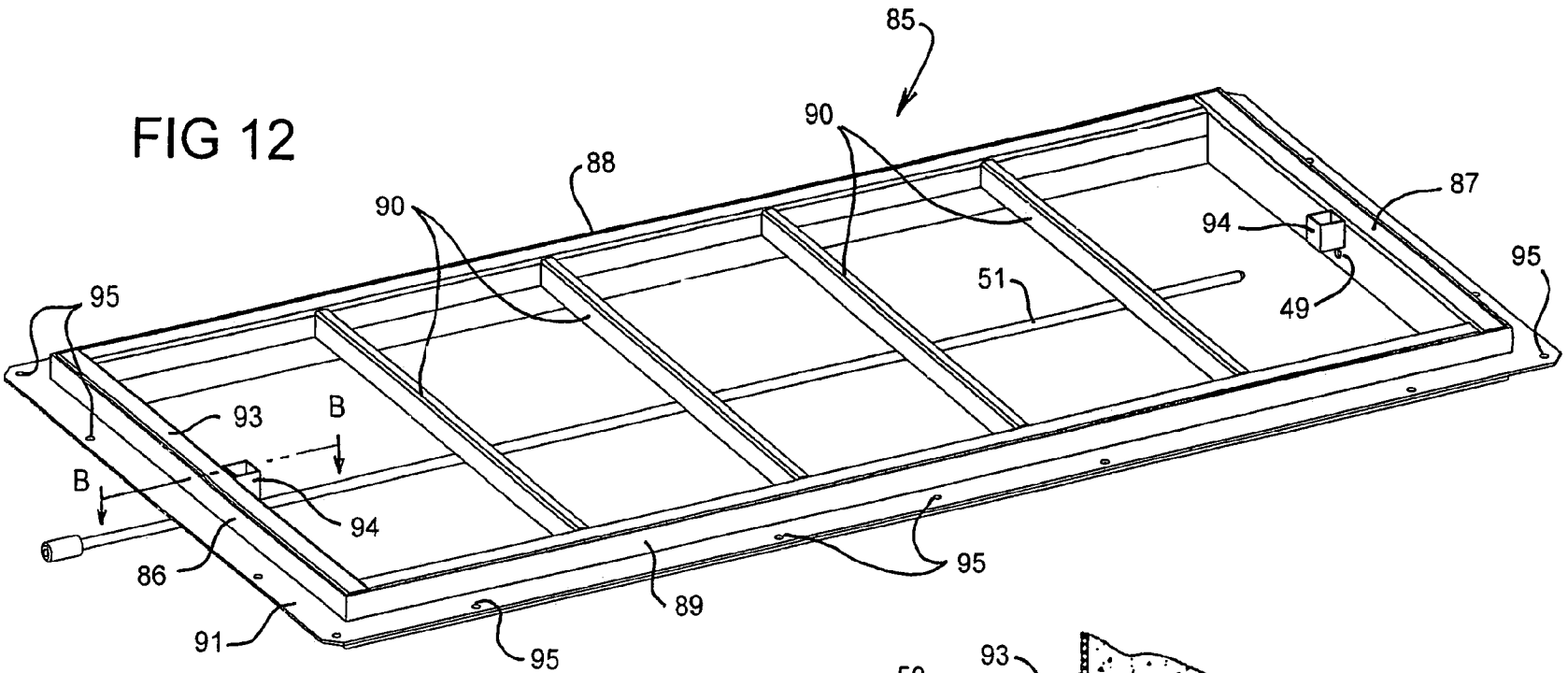
FIG. 12 is a perspective view of a subframe according to the invention.

Each compartment is formed of a subframe, panel walls and if required, a roof. FIG. 12 shows a typical subframe 85 for a compartment having a floor area of about 2.4 m×1.25 m. The subframe 85 is generally rectangular, defining a pair of short ends 86,87 sides 88,89 and a plurality of floor bearers 90. As shown, the short end 87 includes an open end 49 for receipt of one end of the hold-down pin 51, while a corresponding opening is also provided in the short end 86.

Figure 13:
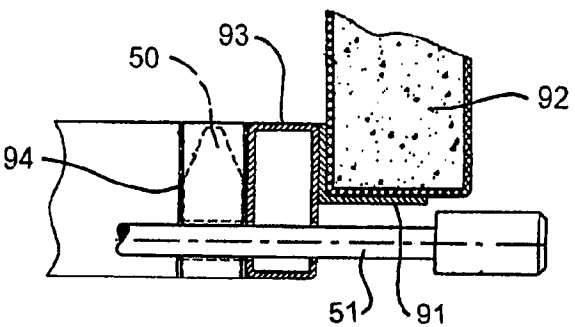
FIG. 13 is a cross-sectional view taken through B—B of FIG. 12.

The subframe 85 defines a peripheral lip 91 which extends fully about the periphery of the frame 85. The lip 91 provides a support for panels which form the walls of each component. A cross-sectional view taken through B—B is shown in FIG. 13. In that figure, a wall panel 92 is shown supported on the lip 91, while further shown is the end channel 93 which forms part of the short end 86 and the adjacent eyelet guide 94 which is arranged for receipt of an eyelet 50 (see also FIG. 7), whereafter the hold-down pin 51 is threaded therethrough as shown for securing the subframe 85 to the base 11.

Each wall panel 92 is fixed to the lip 91 by screw fasteners (not shown) which extend through the lip 91 and through the base of the wall panel 92. FIG. 12 shows a series of openings 95 for receipt of such fasteners. These openings also provide for fastener connection with the joiners 67 and 70 (see FIGS. 9 and 10), through the opening 68 of such joiners.

The flooring applied to each compartment can take any suitable form, and could be a fibreboard such as MDF. A suitable covering may be employed over such a flooring, such as linoleum or carpet. Given that the building 10, is to be used in quite remote locations and is not required to, have a sophisticated flooring finish, the flooring is not necessarily required to be of a high quality.

Figure 4:
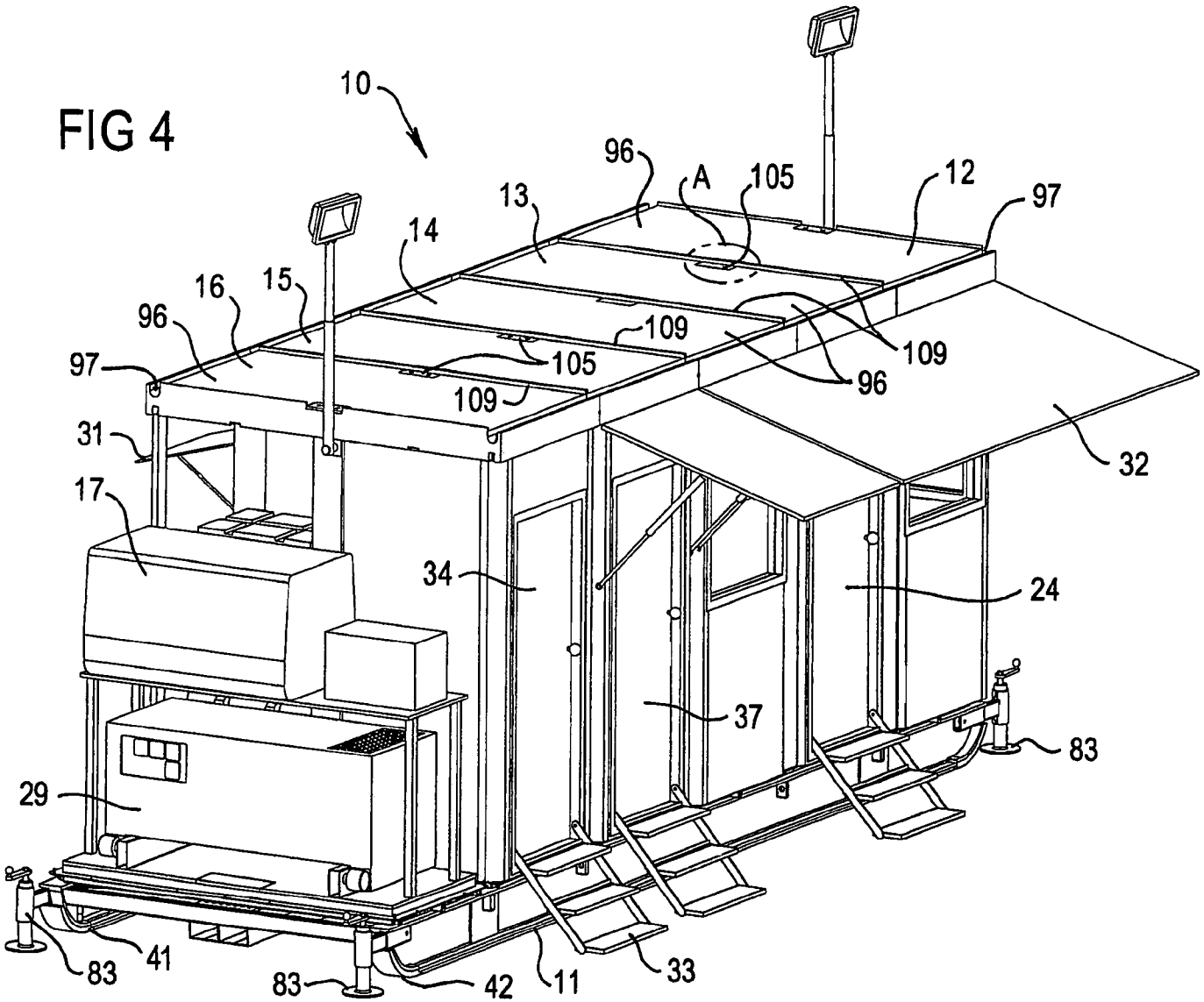

Each of the compartments 12 to 16 includes a roof panel and these are identical in formation and nest together. As shown in FIG. 4, a gutter 97 is formed on each side of the roof.

Figure 14:
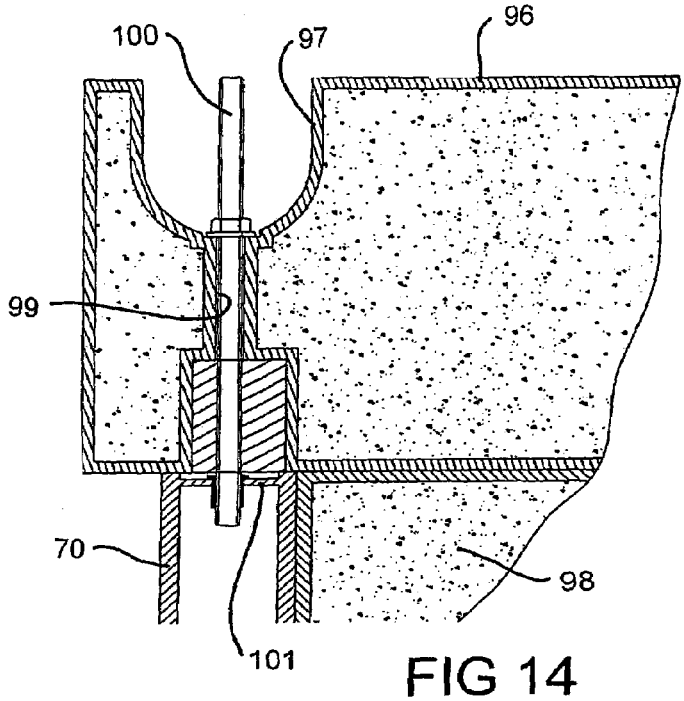
FIG. 14 is a cross-sectional view of the connection between a roof member and a wall panel.

The roof panels are arranged to nest and connect to the side wall panels and the corner and side joiners. The roof panels are also arranged to connect together. FIG. 14 illustrates a cross-sectional view showing the connection through the gutter 97, of a roof panel 96 to the corner joiner 70, which is connected to a side wall panel 98, Each of: these panels is of the same construction as the panels discussed earlier, such that they include a plastic skin filled with an insulating foam.

As shown in FIG. 14, the roof panel 96 includes a gutter 97 and an opening 99 formed in the gutter 97 receives a threaded bolt 100 which extends through the roof panel 96 for threaded connection through the top wall 101 of the joiner 70. It will be appreciated that any number of openings and threaded connections may be provided for through the gutter 97 of each roof panel 96 as required for secure fitting of the roof panels to the respective compartments.

Figure 15:
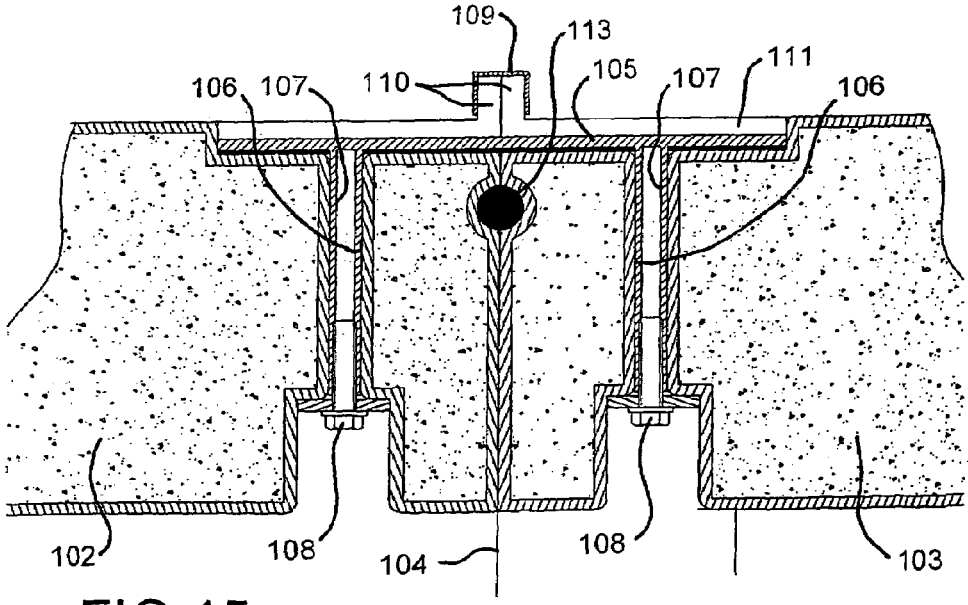
FIG. 15 is a cross-sectional view through the connection between adjacent roof members.

FIG. 15 shows the connection which is made between adjacent roof panels such as between the roof panels 96 of the adjacent compartments 12 and 13. The FIG. 15 connection can be for example, a cross-section taken through the region A shown in FIG. 4.

FIG. 15 shows a pair of roof panels 102 and 103, which meet at a junction 104. To connect the roof panels 102,103 together, a connecting plate 105 bridges the junction 104 and includes threaded spigots 106 which are received in openings 107 in each of the panels 102,103. The spigots 106 are internally threaded and threaded fasteners 108 engage the spigots 106 as shown to secure the connecting plate 105 between the adjacent panels 102,103.

The connecting plate 105 is shown in part in FIG. 4, between each of the roof panels of the compartments 12 to 16. The obscured half of the plate 105 is obscured by a cap 109 which extends across the junction 104 covering upstanding edge sections 110 of each of the panels 102,103, which abut together along the junction 104. The edge sections 110 do not extend across the recess 111 in which the connecting plate 105 is disposed but they extend on either side of that recess 111.

Between the underneath surface of the connecting plate 105 and the upper surface of the panels 102,103, is a gasket 112. Furthermore, the abutting faces of the panels 102,103 each include a semi-circular recess to accommodate a further gasket 113. Each of the gaskets 112 and 113, contribute to weatherproofing the roof formed by the roof panels from admitting rain, snow, dust or dirt into the interior of the building 10.

Figure 11:
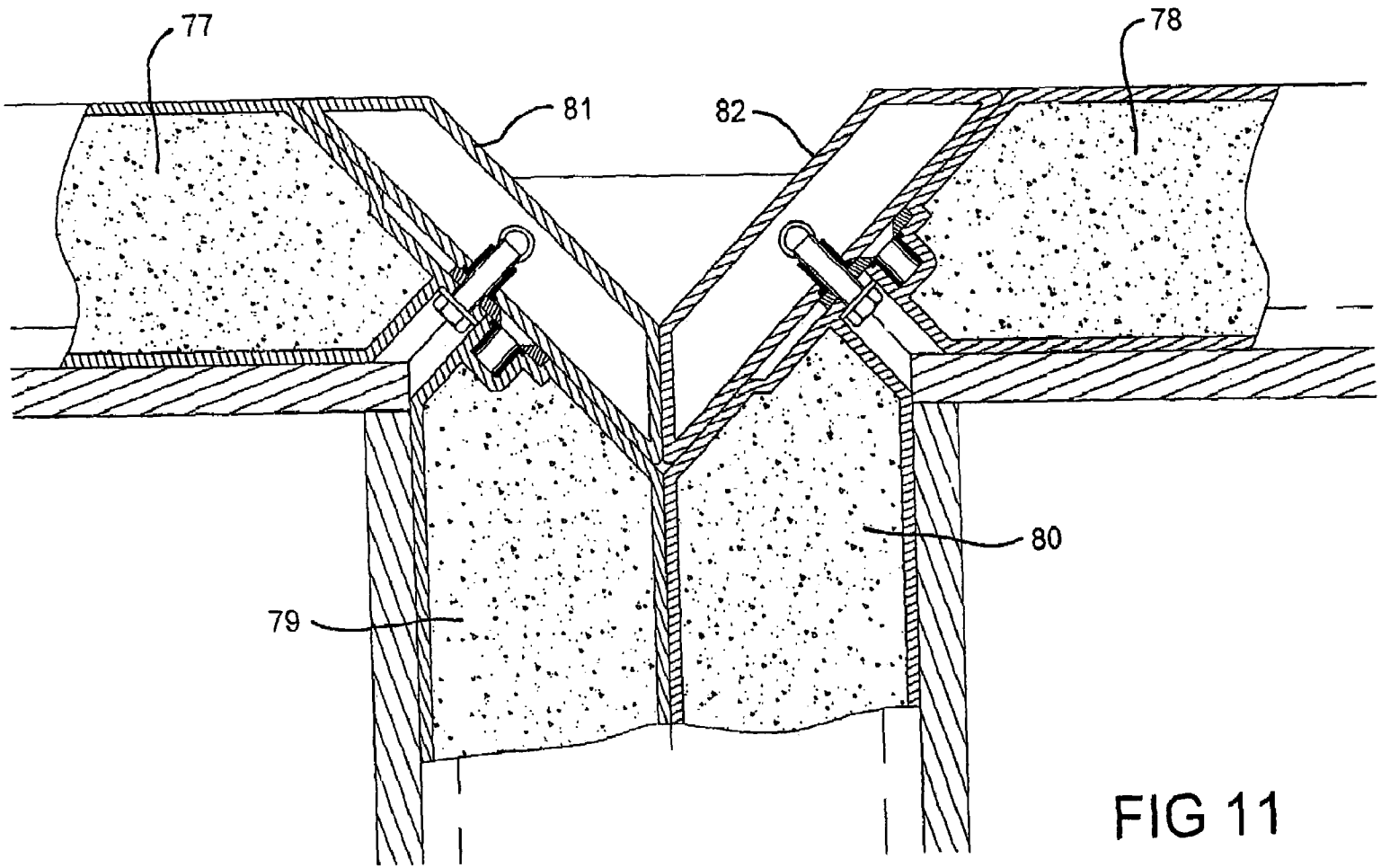
FIG. 11 is a cross-sectional view through the side and end walls of adjacent units.
Figure 16:
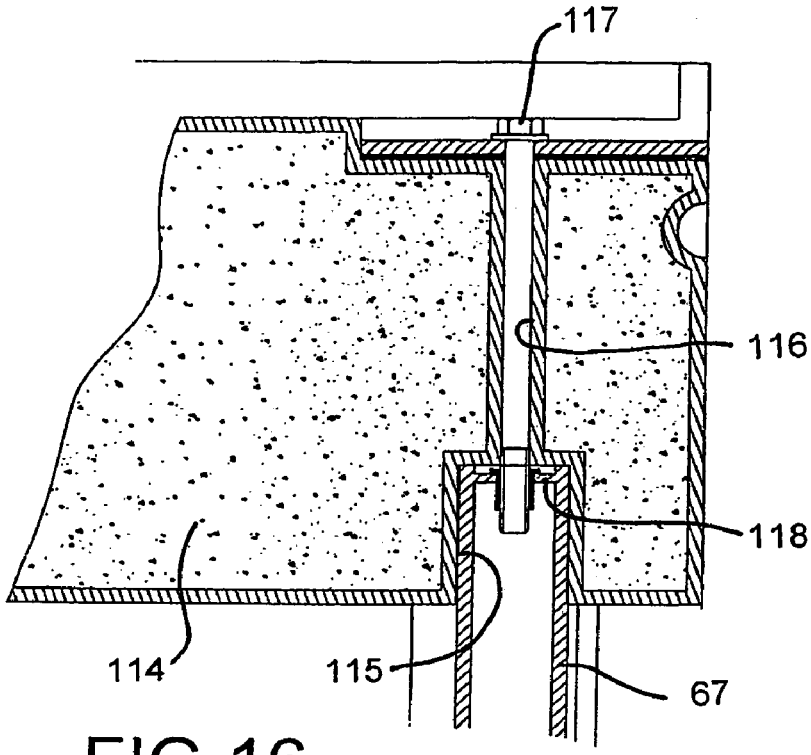
FIG. 16 is a cross-sectional view of the connection between a roof member and a connecting member.

The roof panels also include facility for fixed connection to the joiners 67, 70, such as those shown in FIGS. 9 to 11, and one such arrangement is shown in FIG. 16. In that figure, a side joiner 67 is shown and it can be seen that the roof panel 114 takes the same form as each of the roof panels 102 or 103 shown in FIG. 15. In the FIG. 16 embodiment, the upper end of the joiner 67 is received within the recess 115 and a threaded bolt extends through 20 the opening 116 formed in the roof panel 114. The bolt 117 extends through the opening 116 and into the upper wall 118 of the joiner 67 and connects the roof panel 114 thereto.

Figure 17:
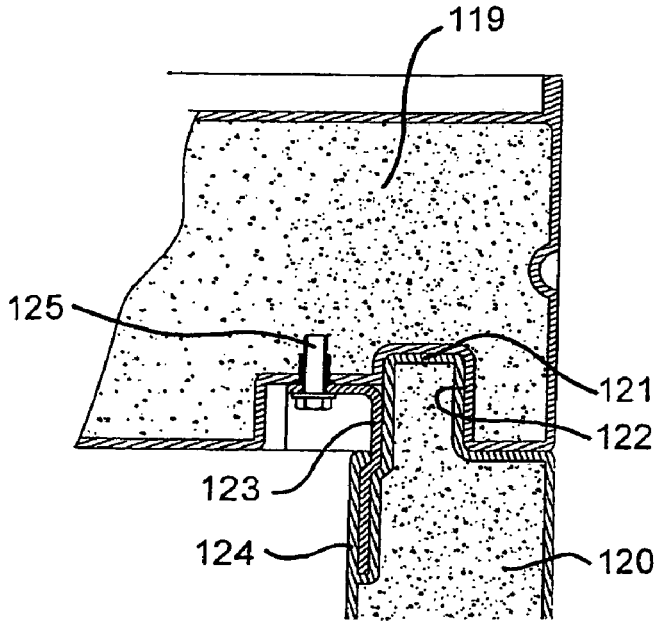
FIG. 17 is a cross-sectional view taken through the connection between a roof member and a wall member.

A final connection arrangement is shown in FIG. 17, in which a roof panel 119 is connected to the upper end of a wall panel 120 by an interlocking protrusion 121 and recess 122 arrangement. In this arrangement, a joiner angle 123 is received within a recess formed in the internal wall 124 of the wall panel 120 and is joined by a threaded fastener 125 to the roof panel 119.

It will be appreciated that the building 10 shown in the various drawings is of a highly modular form, comprised of fabricated components, which can be assembled into a building structure in a convenient manner. In this respect, the wall and roof panels shown in the drawings can be of identical shape and construction, while the various joining members can also be largely identical. This facilitates simple manufacture of these components and also simplifies the selection of components when a building is to be constructed.

It will further be appreciated, that the building components are connected together principally by screw threaded fasteners, which advantageously are simple and convenient to use.

Buildings according to the invention have been found to be extremely robust and rigid. The buildings therefore are able to be transported without significant risk of collapse or failure and are able to withstand high winds and torrential rain. Additionally, the buildings can be deposited by tilt truck in remote locations and moved between locations reasonably easily. This is a particular advantage for the construction of pipelines or other facilities which cover a long distance, as the building can be moved as required to new sites as the construction progresses.

Accordingly, the present invention provides a demountable building which is ideally suited for use in remote locations and which is easy to install, maintain and remove and which may be reconfigured to suit a variety of applications.

As previously discussed, the invention is not limited to the de mountable building as shown in the figures, but can take the form of a structure which employs certain features of the demountable building. A structure according to the invention includes a base, wall and roof sections and connectors. The base of a structure can be in the form of the base 11 of FIGS. 1 and 4, or the subframe 85 of FIG. 12. The wall sections can take the form of the end and sidewalls 56, 57 or 69 shown in the figures, while the roof sections can take the form of the roof panels 96 shown in FIG. 14. The connectors can be in the form of the various joiners 67, 70, 81 and 82 shown in FIGS. 9 to 11.

By utilising the components of the demountable building 10, a structure can be erected very simply and easily, by selecting the required member of wall and roof sections and connectors, and by further selecting a suitable base. These components may then be secured together in the manner described above, but not for the erection of a demountable building, but rather as a structure having some of the characteristics of the demountable building. The structure will not have the same requirements as the demountable building, i.e. it will not require to be of modular unit construction, which units are removably fixable to a base, but the modular nature of the wall and roof sections and the connectors, facilitates the construction of a structure that can be easily assembled by the use of uniform component parts. Additionally, the benefits attributable to the demountable building, i.e. the strength and insulative characteristics also apply to a structure according to the invention.

Finally, it is to be understood that various alterations, modifications and/or additions may be introduced into the construction and arrangements of parts previously described without departing from the spirit or ambit of the invention.

The invention claimed is:

1. A demountable and portable building comprising a base, a plurality of modular units which are arranged for removable connection to said base, each unit being fitted out with functional elements to enable that unit to perform a predetermined function in the operation of the building without requiring connection to facilities external of the building, each unit and its associated functional elements being operative to be connected to, or removed from, said base as a single unit said building being transportable with said units connected to said base, from a first site at which said units are assembled in connection with said base to a second site at which said building is to be operational, said modular units being removable so that a modular unit having functional elements of one kind can be removed and replaced with one or more modular units having functional elements of a different kind.

2. A demountable building according to claim 1, one or more of said units comprising a subframe for mounting on and fixing to said base, and said functional elements being assembled on said subframe.

3. A demountable building according to claim 1, one or more of said units having the form of a compartment comprising a subframe for mounting on and fixing to said base, and a pair of parallel and substantially vertically extending end walls disposed at opposite ends of said subframe and fixed thereto, and a roof member extending between and connected to upper ends of each of said pair of end walls.

4. A demountable building according to claim 3, further comprising a substantially vertically extending side wall which extends from said subframe in fixed connection therewith, between and in connection with edge regions of said pair of end walls and/or edge regions of said roof member, substantially perpendicular to said end walls.

5. A demountable building according to claim 4, said side wall being connected to said end walls along said edge regions thereof by elongate connecting members which extend lengthwise between said edge regions of said pair of end walls and adjacent edge regions of said side wall.

6. A demountable building according to claim 5, said elongate connecting members comprising front and rear walls which are spaced apart and parallel and side walls extending between said front and rear walls, and top and bottom walls which close open ends of said elongate connecting members so that said elongate connecting members define an interior space, fastening means for fastening said elongate connecting members to said end walls and said side wall extending through one of said front and rear walls.

7. A demountable building according to claim 6, said side walls of said elongate connecting members being mutually converging, so that adjacent said side walls of adjacent elongate connecting members can rest flat against one another between adjacent compartments that have side walls in facing and/or abutting relationship.

8. A demountable building according to claim 6, said side walls of said elongate connecting members being mutually converging, and adjacent said edge regions of adjacent said side walls being mutually inclined complementary thereto such that said side walls of said elongate connecting members lay substantially flush against said inclined edge regions, and fastening means extending through said edge regions and through said side walls of said elongate connecting members to connect said side walls of said units to said elongate connecting members.

9. A demountable building according to claim 6, said side walls of said elongate connecting members being mutually converging, and adjacent side edge regions of an end wall and a side wall being inclined, such that one of said front or rear wall of said elongate connecting members lay substantially flush against said adjacent side edge regions and fastening means extending through said side edge regions and through said front or rear wall of said elongate connecting members to connect said end wall and said side wall to said connector.

10. A demountable building according to claim 6, said elongate connecting members being connected to said subframe by fastening means extending through said subframe and said bottom wall.

11. A demountable building according to claim 6, said elongate connecting members being connected to said roof members by fastening means extending through said roof member and said top wall.

12. A demountable building according to claim 3, further comprising a pair of parallel and substantially vertically extending side walls which extend from said subframe in fixed connection therewith between and in connection with edge regions of said pair of end walls and/or edge regions of said roof member substantially perpendicular to said end walls.

13. A demountable building according to claim 3, said end walls being connected to said subframe through a base section thereof by a connector which extends through an opening formed in said subframe and said base section.

14. A demountable building according to claim 3, said end walls being formed to define a hollow interior cavity, said interior cavity being filled with an expansion foam.

15. A demountable building according to claim 3, wherein adjacent end walls of adjacent units are connected along adjacent edge regions thereof by an elongate connecting member which extends lengthwise between said edge regions of said adjacent end walls, said elongate connecting members comprising front and rear walls which are spaced apart and parallel and side walls extending between said front and rear walls, and top and bottom walls which close open ends of said elongate connecting members so that said elongate connecting members define an interior space, said side walls of said elongate connecting members being mutually converging, and said adjacent edge regions being mutually inclined complementary thereto so that said side walls of said elongate connecting members lay substantially flush against said mutually inclined edge regions, and fastening means extending through said adjacent edge regions and through said side walls of said elongate connecting members to connect said end walls to said elongate connecting members.

16. A demountable building according to claim 3, said roof member being generally square or rectangular and having a pair of end sections and a pair of side sections extending perpendicular to said end sections, adjacent roof members in use being connected separately at end sections thereof to end walls of an adjacent modular unit and being connected together by connecting means which connect across adjacent side sections.

17. A demountable building according to claim 16, said adjacent side edges abutting each other, and the abutting faces being sealed.

18. A demountable building according to claim 3, said base including ducting for service connection to said compartments.

19. A demountable building according to claim 18, said ducting being positioned centrally of said base between opposite sides thereof and extending between opposite ends thereof, said ducting including service point connections for cooperating with complementary service point connections of said units for facilitating provision of service to said units.

20. A demountable building according to claim 19, said service point connections providing for electrical and water supply, and waste discharge.

21. A demountable building according to claim 19, said service point connections of said ducting and said units being respectively positioned so that said service point connections align for cooperation regardless of the type of unit connected to said base.

22. A demountable building according to claim 19, said service point connections being equidistantly spaced along said ducting and said complementary service point connections of said units being positioned uniformly in each unit so that said service point connections align for cooperation regardless of the type of unit connected to said base.

23. A demountable building according to claim 1, said base including skids for dragging said building over a surface.

24. A wall or roof member for use in a demountable building according to claim 1.

25. A modular structure comprising a base, wall sections, roof sections and connectors for connecting adjacent wall sections and adjacent roof sections, the roof and wall sections being selected generally from a single predetermined size of respective wall and roof section for construction of said modular structure, said connectors extending lengthwise of said wall sections and comprising opposite side connection portions facilitating connection between said connectors on either side thereof to adjacent wall sections and connection portions for connection respectively to said roof sections and said base said connectors comprising front and rear walls which are spaced apart and parallel and side walls extending between said front and rear walls, and top and bottom walls which close open ends of said connectors so that said connector defines an interior space, said side walls of said connectors being mutually converging, and adjacent edge regions of adjacent, generally coplanar said wall sections being mutually inclined complementary thereto such that said side walls of a said connector lay substantially flush against said inclined edge regions, and fastening means extend through said edge regions and through said side walls of said connector to connect said wall sections to said connector.

26. A modular structure comprising a base, wall sections, roof sections and connectors for connecting adjacent wall sections and adjacent roof sections, the roof and wall sections being selected generally from a single predetermined size of respective wall and roof section for construction of said modular structure, said connectors extending lengthwise of said wall sections and comprising opposite side connection portions facilitating connection between said connectors on either side thereof to adjacent wall sections and connection portions for connection respectively to said roof sections and said base, said connectors comprising front and rear walls which are spaced apart and parallel and side walls extending between said front and rear walls, and top and bottom walls which close open ends of said connectors so that said connector defines an interior space, said side walls of said connectors being mutually converging, and adjacent side edge regions of adjacent wall sections disposed perpendicular to each other being inclined, such that one of said front or rear wall of said connector lays substantially flush against said adjacent side edge regions and fastening means extending through said side edge regions and through said front or rear wall of said connector to connect said wall sections to said connector.

* * * * *